US005993711A

United States Patent [19]

Grunstra

[11] Patent Number: 5,993,711

[45] Date of Patent: Nov. 30, 1999

[54] PROCESS OF AND APPARATUS FOR MAKING TAPES OR YARNS

[75] Inventor: Hendrik Grunstra, Sneek, Netherlands

[73] Assignee: Lankhorst Indutech B.V., Sneek, Norway

[21] Appl. No.: 09/016,066

[22] Filed: Jan. 30, 1998

[30] Foreign Application Priority Data

Jan. 13, 1998 [EP] European Pat. Off. ..... 9800063

[51] Int. Cl.[6] ..... D01D 5/42; D01D 5/253; D02G 3/00

[52] U.S. Cl. ..... 264/103; 264/147; 264/167; 264/177.1; 264/177.16; 425/308; 425/382 R; 425/464; 425/465

[58] Field of Search ..... 264/103, 147, 264/167, 177.1, 177.16; 425/308, 382 R, 464, 465

[56] References Cited

U.S. PATENT DOCUMENTS 4,271,104 6/1981 Anderson et al. ..... 264/167 X

FOREIGN PATENT DOCUMENTS 30204 77 A 5/1979 Australia .
183 180 A2 6/1986 European Pat. Off. .
853 145 A1 7/1998 European Pat. Off. .
1111551 5/1968 United Kingdom .

OTHER PUBLICATIONS

Patent Abstracts of Japan, vol. 003, No. 095 (C–055), Aug. 11, 1979 & JP 54 073920 A (Chisso Corp), Jun. 13, 1979.

*Primary Examiner*—Leo B. Tentoni
*Attorney, Agent, or Firm*—Pearne, Gordon, McCoy & Granger LLP

[57] ABSTRACT

For manufacturing tape or yarns, plastic polymer material is extruded into a film (20, 21) having a pattern of parallel, longitudinal, alternating ribs (31, 32) and deep, narrow grooves (33, 34) on each of its two opposite sides, at least a plurality of the grooves (33, 34) in one side each being located diametrically opposite one of the grooves (34, 33) in the other, opposite side. Yarns and tapes obtained in the form of or from such a film typically have a substantially improved tensile strength and are more supple and smooth.

19 Claims, 2 Drawing Sheets

PROCESS OF AND APPARATUS FOR MAKING TAPES OR YARNS

FIELD AND BACKGROUND OF THE INVENTION

The invention relates to a process for manufacturing tapes or yarns, to a die and to a system for use in that process.

A known process for manufacturing tapes and yarns of polymer material is to extrude the material in the form of a film, to draw the film in the direction of extrusion and to divide the film longitudinally into tapes or strands. As for most other type of yarn or tape, a major objective in the development of yarns and tapes of this type is generally to achieve a maximal tensile strength.

One known process step contributing to increasing the tensile strength is to draw the extruded material, usually while submitting it to a heat treatment, so that polymer chains in the material are aligned in longitudinal direction.

AU-B1-30,204/7 discloses a process in which a plastic polymer material is extruded into a film having a pattern of parallel, longitudinal, alternating ribs and grooves on each of its two opposite sides. The grooves in one side each are located diametrically opposite one of the grooves in the other, opposite side. The grooves are formed using a die having opposite die lips both provided with projecting groove-forming protrusions, the groove-forming protrusions of opposite lips being located diametrically opposite each other. The extruded film is longitudinally cleaved in production (the tape may also cleave in use if heavily loaded), by slitting between ridges. Furthermore, this document discloses a die for extruding a drawable film of polymer material, which die has an extrusion gap between generally parallel, mutually spaced, opposite lips. The lips each have a toothed profile formed by alternating groove-forming protrusions and recesses for extruding a film as described. The recesses in one lip are each located diametrically opposite one of the recesses in the other, opposite lip. A film as described is also disclosed in this document.

SUMMARY OF THE INVENTION

It is an object of the invention to provide tapes or yarns with an increased tensile strength.

According to the invention, this object is achieved by providing a process for manufacturing tape or yarns, in which a plastic polymer material is extruded into a film having a pattern of parallel, longitudinal, alternating ribs and grooves on each of its two opposite sides, at least a plurality of the grooves in one side each being located diametrically opposite one of the grooves in the other, opposite side, the film is longitudinally cleaved into a plurality of fibers or groups of fibers each formed by at least a section of at least one pair of opposite ones of the ribs, and the grooves are formed using a die having opposite die lips both provided with projecting groove-forming protrusions, the groove-forming protrusions of opposite lips being located diametrically opposite each other and projecting into the die opening over a distance larger than the respective widths of the protrusions, and the cleaving of the film is carried out by submitting at least tape-portions of the film to at least one of a shear load and a load having a transverse component.

According to another aspect of the invention, a die for extruding a drawable film of polymer material is provided which is specifically adapted for use in the above-described process and which has an extrusion gap between generally parallel, mutually spaced, opposite lips, the lips each having a toothed profile formed by alternating groove-forming protrusions and recesses for extruding a film having a pattern of parallel, longitudinal, alternating ribs and grooves on each of its two opposite sides. At least a plurality of the recesses in one lip are each located diametrically opposite one of the recesses in the other, opposite lip. The groove-forming protrusions project into the die opening over a distance larger than the respective widths of the protrusions.

The invention can also be embodied in a system for manufacturing yarns or tape of polymer material, including an extruder provided with a die as set forth above and a cleaving station for longitudinally cleaving the film into a plurality of fibers or groups of fibers each formed by at least a section of at least one pair of opposite ones of the ribs by submitting at least tape-portions of the film to at least one of a shear load and a load having a transverse component.

According to yet another aspect of the invention a tape or yarn is provided which is obtained by the above-described process.

According to still another aspect of the invention a tape or yarn of extruded and longitudinally drawn polyolefin material is provided, which includes at least portions formed by fibre groups forming tape portions having a pattern of parallel, longitudinal, alternating ribs and grooves on each of its two opposite sides, at least a plurality of the grooves on one side each being located diametrically opposite one of the grooves on the other, opposite side and at least the tape portions being grooved to provide the tape or yarn with a tensile strength of at least 7.0 g/denier.

By forming the pattern of ribs and grooves using diametrically opposite groove-forming protrusions projecting into the die opening from opposite sides over a distance larger than the respective widths of the protrusions, and by cleaving the film or at least tape-portions obtained therefrom by submitting at least tape-portions to a shear load and/or a load having a transverse component, a very supple yet strong tape or yarn material is obtained. Since the cleaving of the film or tape can thus be achieved without slitting or cutting, a very fine and smooth fiber structure is achieved and the conventionally associated need of a large number of cutting tools for the cleaving process is obviated.

It is noted that the toothed profile of the lips, and accordingly the pattern formed on the sides of the film, can have many shapes, such as shark toothed, trapezium shaped, wavy, rectangular and combinations thereof with convex and/or concave curved sections.

Particularly advantageous embodiments of the invention are set forth in the dependent claims.

Hereinafter, the invention as well as particular embodiments and advantages of the invention are described in detail with reference to the accompanying drawings.

DETAILED DESCRIPTION OF THE PREFERRED EMBODIMENTS OF THE INVENTION

Figure 4:
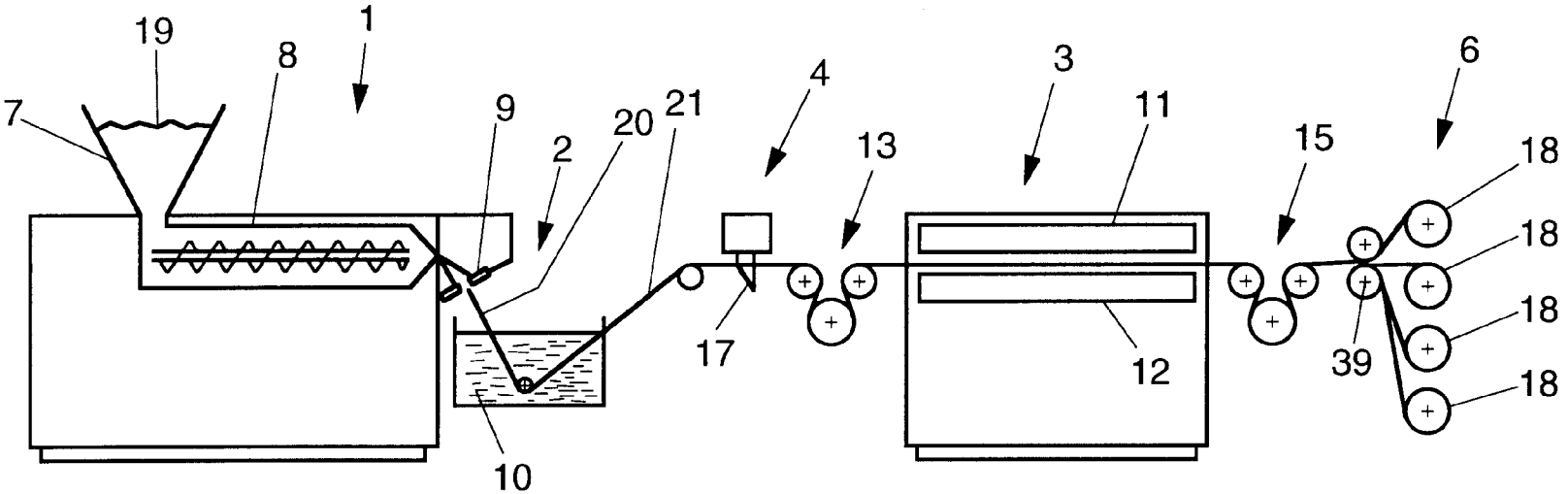
FIG. 4 is a schematic side view of a system according to the invention.

First, a process for manufacturing tapes or yarns is described in general with reference to the system shown in FIG. 4. The shown system is constituted by an extruder 1, a cooling bath 2, a drawing station 3, a cutting station 4 and a collecting station 6. The extruder 1 includes a hopper 7, a plasticising-unit 8 and a die 9 communicating with each other. The cooling bath 2 contains water 10, but the use of other cooling media, liquid or gaseous, or absorption of heat by for example radiation are also conceivable. The drawing station 3 includes heating members 11, 12 between a low-speed haul off formed by a set of rollers (cylinders) 13 and a high-speed haul off formed by a set of rollers 15. The cutting station 4 includes a row of knives 17 for cutting the passing film into tapes and trimming off side edges of the film material. These trimmed side-edges can be recycled into the extruder 1. The collecting station 6 includes a set of driven coils 18 downstream of a pair of rollers 39. Since, apart from the die 9, the system can be of a commercially available design, the other components of the system are not described in further detail.

In operation, polymer material 19, preferably in granular form, is fed into the hopper 7, plasticized in the screw 8 and extruded through the die 9 in the form of a hot film 20. The hot film 20 is passed through the water bath 10 to become solid film 21.

The film 21 is then cut into tapes at the cutting station 4.

The tape material cut from the solid film 21 is subsequently passed to the drawing station 3 where it is drawn. Polypropylene is preferably drawn to a ratio between 6:1 and 18:1.

Finally, the tapes are each wound onto one of the coils 18. In principle, tape can be manufactured by extruding the film in a width which, taking into account the reduction in width occurring during drawing, corresponds to the desired width of the tape to be manufactured. However, in practice it is generally preferable to extrude the film in a width corresponding to the width of a plurality of tapes and an irregular edge portion to be trimmed off, and to cut the extruded film into a plurality of tapes.

Figure 1:
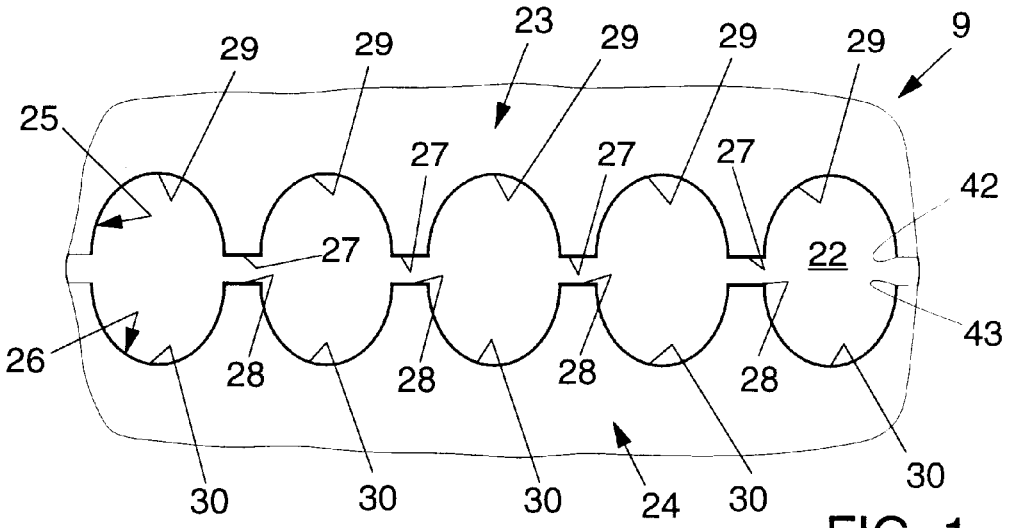
FIG. 1 is a frontal view of a first example of a portion of a die according to the invention.
Figure 2:
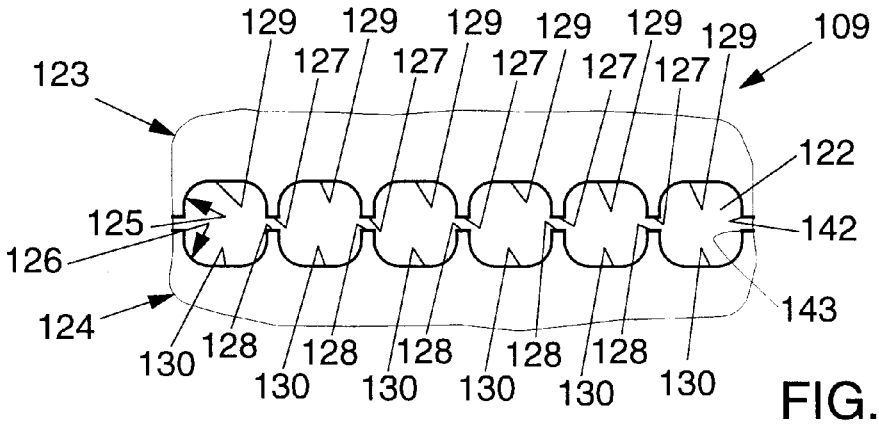
FIG. 2 is a frontal view of a second example of a portion of a die according to the invention.
Figure 3:
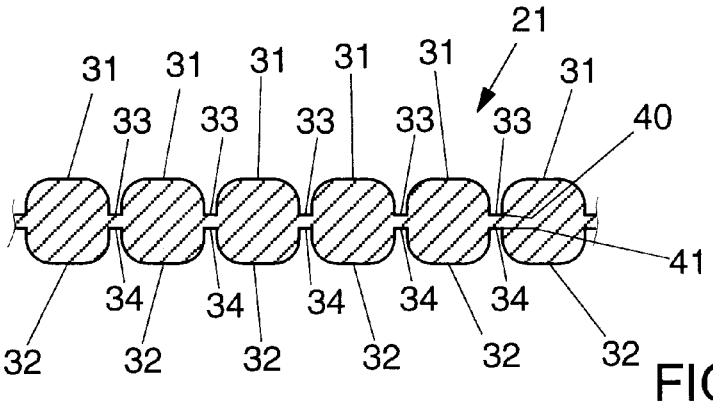
FIG. 3 is a view in transverse cross-section of an example of a film according to the invention.

In FIGS. 1–3, only portions of dies 9, 109 and a film 21 are shown, so that details of the cross-sections of the dies 9, 109 and the film 21 can be shown in an enlarged representation (at a scale of about 10:1). The dies 9, 109 shown in FIGS. 1 and 2 are suitable for extruding drawable film of polymer material in a system as described above with reference to FIG. 4.

The die 9 partially shown in FIG. 1 has an extrusion gap 22 between generally parallel, mutually spaced, opposite lips 23, 24. The lips 23, 24 each have a toothed profile 25, 26 delimiting the gap 22, which profiles 25, 26 are each formed by alternating protrusions 27, 28 and recesses 29, 30, for extruding a film having a pattern of parallel, longitudinal, alternating ribs and grooves on each of its two opposite sides. The recesses 29, 30 in one lip 23, 24 are each located diametrically opposite a recess 30, 29 in the other, opposite lip 24, 23.

In FIG. 2, a die 109 of a different design is shown. This die 109 too has an extrusion gap 122 between generally parallel, mutually spaced, opposite lips 123, 124, each of the lips 123, 124 having a toothed profile 125, 126 formed by alternating protrusions 127, 128 and recesses 129, 130 in positions such that the recesses 129, 130 in one lip 123, 124 are each located diametrically opposite a recess 130, 129 in the other, opposite lip 124, 123.

In operation, polymer material is extruded through the gap 22, 122 in the die 9, 109 and forms a film 21. A schematic representation of an example of such a film 21—which can be extruded from the die 109 shown in FIG. 2—is shown in FIG. 3. The film 21, which in reality will be of a smoother shape, has a pattern of parallel, longitudinal, alternating ribs 31, 32 and grooves 33, 34 on each of its two opposite sides. The grooves 33 in one side of the extruded film 21 are each located diametrically opposite a groove 34 in the other, opposite side of that film 21.

Surprisingly, tape or yarn obtained from such a film 21 (and tape formed by such a film) exhibits a tensile strength which is typically about 20–40% higher than the tensile strength of similar tape or yarn of the same effective cross-sectional area and formed from film of identical material, but extruded from a die having a profiled lip on only one side, if the protrusions have heights which are larger than the widths of these protrusions, the heights of the protrusions preferably being at least 1.5 times and more preferably about 2 times the widths of the protrusions. In this example, the widths of each protrusion is measured at half the distance over which the respective protrusion projects.

More in particular, the film is preferably grooved to provide tape or yarn having a tensile strength of at least 7.0 g/denier and, in order of increasing preference, of at least 7.5, 7.8, 8.0 or 8.5 g/denier. The fineness of the fibers is preferably in a range from 1500–15,000 denier.

In addition to this improved tenacity, such tapes and yarns obtained from film 21 having patterns of ribs 31, 32 and grooves 33, 34 on both sides are typically more supple and smooth than tapes and yarns of a similar constitution but made from film profiled on only one side and having an essentially flat surface on the opposite side.

The reasons for these advantages have not been thoroughly investigated thus far, but it is believed that, by providing profiles of ribs 31, 32 and deep, narrow grooves 33, 34 on both sides, an improved alignment of polymer chains in the ribs 31, 32 is obtained and free cleaving of the material in production, which is facilitated thereby, provides an even distribution of loads over the fibers. This is probably enhanced by the more compact fiber bodies formed by pairs of opposite ribs 31, 32. The compactness of the bodies formed by pairs of opposite ribs may also contribute to a more favorable distribution of loads within each fiber body. It has also been observed that tape obtained from film 21 with profiles on both sides as described above is cleaved or fibrillated in longitudinal direction more easily, but the cleaves generally follow the webs between fiber contours formed by opposite pairs of ribs 31, 32 more closely than in tapes and yarns obtained from film profiled on one side only. Accordingly, cleaves extend across fiber bodies less frequently than in yarn or tape obtained from film which is profiled on one side only, so that the fibers formed by pairs of opposite ribs 31, 32 are less prone to failure.

The operation of longitudinally cleaving the tapes obtained from the film 21 into a plurality of fibers or groups of fibers is carried out by submitting the tapes to a shear load and/or to a load having a transverse component. Cleaving in this manner can be carried out in a simple manner as appears from the example set forth below.

Shear stress in the tapes can for example be obtained by providing that successive rollers—for instance the rollers 15, 39—are smoothly or stepwise tapered in opposite axial directions. Transversal tensile stress can for example be generated by providing rollers of which the circumferential surface has a shark-toothed or wavy shape in axial cross-section.

Submitting the film or the tapes cut therefrom to shear loads or tensile load having a transverse component can also be carried out by twining tape-shaped film sections into yarns in a twining station (not shown). Thus, the step of twining, which is required anyway in many applications such as the manufacture of ropes, also includes the operation of cleaving the film into individual fibers or groups of fibers.

Accurate cleaving of the shown film 21 along webs formed by opposite pairs of grooves 33, 34 is particularly enhanced by the feature that the grooves 33, 34 have bottom regions including relatively sharp interior edges 40, 41 (only one of each is designated by a reference numeral). These sharp interior edges 40, 41 increase stress concentrations in the webs formed by opposite pairs of grooves 33, 34. This increases the ease with which the film material is cleaved in longitudinal direction and enhances the tendency of cleaves or creases in the film material to follow the grooves 33, 34 and not to intersect the ribs 32, 33.

To obtain such film with relatively sharp interior edges 40, 41 in the grooves, the protrusions 28, 128 of the dies 9, 109 have top regions provided with sharp outer edges 42, 43, 142, 143 (only one of each is designated by a reference numeral).

The ribs 31, 32 of the film shown in FIG. 3 have larger widths than the grooves 33, 34 of that film. This is advantageous, because it further enhances the extent to which cleaves and creases in the film material tend to follow the grooves 33, 34. In addition, the narrower the grooves 33, 34 are, the smaller is the quantity of film material in the webs between each pair of opposite ribs 31, 32, which webs contribute little to the tensile strength of the end product. To manufacture such film 21, the recesses 129, 130 of the die 109 shown in FIG. 2 have larger widths than the protrusions 127, 128 thereof, preferably the widths of the grooves is 3 to 10 times the widths of the protrusions, the widths preferably being measured at half the distance over which the protrusions project.

For obtaining supple yet strong tape or yarn, it is further advantageous if the film is extruded from the die 9 shown in FIG. 1 of which diametrically opposite recesses 29, 30 and gap-portions in between define substantially circular cross-sections.

Yarns exhibiting similar advantages, but having slightly more compact strands after twining, are obtained if the film is obtained by extruding from the die 109 shown in FIG. 3, of which diametrically opposite recesses 129, 130 and gap-portions in between define substantially square cross-sections with rounded corners. se are obtained from a film such as the film 21 shown in FIG. 3. Diametrically opposite ribs 31, 32 and film material in between of this film 21 define substantially square cross-sections with rounded corners. Sides of the square cross-sections may be cambered, i.e. having a convex shape with a relatively large radius or large radii.

Yarns having particularly compact strand are also obtained if the ribs are of a tapered design, such that essentially hexagonal fiber bodies are obtained.

The proposed methods, dies and films are especially suitable for application in the manufacture of tapes and yarns from polyolefins, such as materials of which polypropylene, polyethylene or a copolymer of monomers from $C_2$–$C_6$ is at least a major constituent.

Below, a reference example and three examples of yarns obtained in accordance with the present invention are described. It is noted that, of course, properties of the tape and yarn depend on other process variables as well, such as the drawing ratio, the distance between the lips (the average film thickness typically being between 60 and 140 $\mu$m), the extrusion pressure and the distance between the die and the cooling medium.

Although the results of the examples set forth below may be slightly influenced by differences in process variables and differences in optimal processing variables due to differences in the cross-sect:ion of the extruded film, these results clearly show that a substantially higher tensile strength is obtained by manufacturing from a film having profiles with deep, narrow grooves on both sides than from a film having a similar profile on one side only.

| | |
|---|---|
| Reference example | |
| Fineness of the yarn: | 5,000 denier |
| Intermediate material: | single-side profiled PP film |
| Tensile strength: | 6.5 g/denier |
| Elongation at break: | 13% |
| Example 1 | |
| Fineness of the yarn: | 5,000 denier |
| Intermediate material: | two-side profiled PP film |
| Tensile strength: | 8.5 g/denier |
| Elongation at break: | 15% |
| Example 2 | |
| Fineness of theyarn: | 10,000 denier |
| Intermediate material: | two-side profiled PP film |
| Tensile strength: | 8.3 g/denier |
| Elongation at break: | 13% |
| Example 3 | |
| Fineness of the yarn: | 2,500 denier |
| Intermediate material: | two-side profiled PP film |
| Tensile strength: | 10.0 g/denier |
| Elongation at break: | 13% |

What is claimed is:

1. A process for manufacturing tapes or yarns, comprising the steps of:

extruding a plastic polymer material into a film having a pattern of parallel, longitudinal, alternating ribs and grooves on each of its two opposite sides, at least a plurality of said grooves in one side each being located diametrically opposite one of said grooves in the other, opposite side, using a die having opposite die lips both provided with projecting groove-forming protrusions, said groove-forming protrusions of opposite lips being located diametrically opposite each other, longitudinally cleaving the film into a plurality of fibers or groups of fibers each formed by at least a section of at least one pair of opposite ones of said ribs, said groups of fibers forming said tapes or said fibers or groups of fibers being processed into said yarns, wherein the groove-forming protrusions project into the die opening over a distance larger than the respective widths of said protrusions, and the cleaving of the film is carried out by submitting at least tape-portions of the film to at least one of a shear load and a load having a transverse component.

2. A process according to claim 1, wherein the groove-forming protrusions project into the die opening over a distance larger than 1.5 times the respective widths of said protrusions.

3. A process according to claim 2, wherein the film is submitted to at least one of a shear load and a load having a transverse component by twining tape-shaped film into a yarn.

4. A process according to claim 1, wherein the spacings between the groove-forming protrusions are 3 to 10 times the respective width of the groove-forming protrusions.

5. A process according to claim 1, wherein the film which is being extruded has diametrically opposite ribs and film material in-between defining substantially circular cross-sections.

6. A process according to claim 1, wherein the film which is being extruded has diametrically opposite ribs and film material in between defining substantially square cross-sections with rounded corners.

7. A process according to claim 1, wherein the grooves have bottom regions including sharp interior edges.

8. A process according to claim 1, wherein the film includes at least one polymer material of the group consisting of polypropylene, polyethylene and copolymers of at least two monomers in the range $C_2$–$C_6$.

9. A die for extruding a drawable film of polymer material, said die having an extrusion gap between generally parallel, mutually spaced, opposite lips, said lips each having a toothed profile formed by alternating groove-forming protrusions and recesses for extruding a film having a pattern of parallel, longitudinal, alternating ribs and grooves on each of its two opposite sides, at least a plurality of said recesses in one lip each being located diametrically opposite one of said recesses in the other, opposite lip, said groove-forming protrusions projecting into said die opening over a distance larger than the respective widths of said protrusions.

10. A die according to claim 9, wherein the groove-forming protrusions project into said die opening over a distance larger than 1.5 times the respective widths of said protrusions.

11. A die according to claim 9, wherein said recesses have larger widths than said groove-forming protrusions.

12. A die according to claim 9, wherein diametrically opposite recesses and gap-portions in-between define substantially circular cross-sections.

13. A die according to claim 9, wherein diametrically opposite recesses and gap-portions in-between define substantially square cross-sections with rounded corners.

14. A die according to claim 9, wherein the protrusions are trapezium-shaped.

15. A die according to claim 9, wherein the protrusions have top regions including sharp outer edges.

16. An apparatus for manufacturing tapes or yarns of polymer material, including:

an extruder equipped with a die for extruding a drawable film of polymer material, said die having an extrusion gap between generally parallel, mutually spaced, opposite lips, said lips each having a toothed profile formed by alternating groove-forming protrusions and recesses for extruding a film having a pattern of parallel, longitudinal, alternating ribs and grooves on each of its two opposite sides, at least a plurality of said recesses in one lip each being located diametrically opposite one of said recesses in the other, opposite lip, said groove-forming protrusions projecting into said die opening over a distance larger than the respective widths of said protrusions, and a cleaving station for longitudinally cleaving the film into a plurality of fibers or groups of fibers each formed by at least a section of at least one pair of opposite ones of said ribs by submitting at least tape-portions of the film to at least one of a shear load and a load having a transverse component.

17. An apparatus according to claim 16, wherein said cleaving station is a twining station for twining tape-shaped film into a yarn.

18. A process according to claim 1, wherein the groove-forming protrusions project into the die opening over a distance larger than 2 times the respective widths of said protrusions.

19. A die according to claim 9, wherein the groove-forming protrusions project into said die opening over a distance larger than 2 times the respective widths of said protrusions.

* * * * *

UNITED STATES PATENT AND TRADEMARK OFFICE

CERTIFICATE OF CORRECTION

PATENT NO. : 5,993,711
DATED : November 30, 1999
INVENTOR(S) : Hendrik Grunstra

It is certified that error appears in the above-indentified patent and that said Letters Patent is hereby corrected as shown below:

On the Title Page, Item [75] after "Sneek," insert --the--.

On the Title Page, Item [73] after "Sneek," delete "Norway" and insert --the Netherlands--.

On the Title Page, Item [30] delete "9800063" and insert --98200063--.

Column 6, line 4 delete "cross-sect:ion" and insert --cross-section--.

Column 6, line 22 delete "theyarn:" and insert --the yarn:--.

Signed and Sealed this

Eighth Day of August, 2000

*Attest:*

*Attesting Officer*

Q. TODD DICKINSON

*Director of Patents and Trademarks*